US006397476B1

(12) United States Patent
Onion

(10) Patent No.: US 6,397,476 B1
(45) Date of Patent: Jun. 4, 2002

(54) OPENING AND CLOSING ASSISTING MECHANISM FOR A FOLDING KNIFE

(75) Inventor: Kenneth J. Onion, Kapolei, HI (US)

(73) Assignee: Kai U.S.A. Ltd., Wilsonville, OR (US)

( * ) Notice: Subject to any disclaimer, the term of this patent is extended or adjusted under 35 U.S.C. 154(b) by 0 days.

(21) Appl. No.: 09/648,513

(22) Filed: Aug. 25, 2000

Related U.S. Application Data

(63) Continuation of application No. 09/096,870, filed on Jun. 11, 1998, now Pat. No. 6,145,202.
(60) Provisional application No. 60/077,390, filed on Mar. 10, 1998.

(51) Int. Cl.[7] ..... B26B 1/04
(52) U.S. Cl. ..... 30/160; 30/161; 30/159
(58) Field of Search ..... 30/155, 158, 159, 30/160, 161

(56) References Cited

U.S. PATENT DOCUMENTS

| | | | | | |
|---|---|---|---|---|---|
| 226,910 | A | | 4/1880 | Friebertshauser | |
| 551,052 | A | * | 12/1895 | Shonnard et al. | 30/159 |
| 749,230 | A | | 1/1904 | Severance | |
| 969,909 | A | * | 9/1910 | Schrade et al. | 30/159 |
| 1,454,665 | A | | 5/1923 | Bobek | |
| 1,743,022 | A | | 1/1930 | Carman | |
| 4,040,081 | A | | 8/1977 | Ninomiya et al. | |
| 4,347,665 | A | | 9/1982 | Glesser | |
| 4,404,748 | A | | 9/1983 | Wiethoff | |
| 4,451,982 | A | * | 6/1984 | Collins | 30/161 |
| 4,502,221 | A | | 3/1985 | Pittman | |
| 4,719,700 | A | | 1/1988 | Taylor, Jr. | |
| 4,805,303 | A | | 2/1989 | Gibbs | |
| 4,811,486 | A | | 3/1989 | Cunningham | |
| 4,837,932 | A | | 6/1989 | Elsener | |
| 4,896,424 | A | | 1/1990 | Walker | |
| 4,974,323 | A | | 12/1990 | Cassady | |
| 4,979,301 | A | | 12/1990 | Walker | |
| 5,044,079 | A | | 9/1991 | Gibbs | |
| 5,060,379 | A | | 10/1991 | Neely | |
| 5,095,624 | A | * | 3/1992 | Ennis | 30/161 |
| 5,111,581 | A | * | 5/1992 | Collins | 30/161 |
| 5,293,690 | A | | 3/1994 | Cassady | |
| 5,331,741 | A | | 7/1994 | Taylor, Jr. | |
| 5,400,509 | A | | 3/1995 | Collins | |
| 5,437,101 | A | | 8/1995 | Collins | |
| D365,266 | S | | 12/1995 | Hasegawa | |
| 5,502,895 | A | | 4/1996 | Lemaire | |
| 5,515,610 | A | | 5/1996 | Levin et al. | |
| 5,537,750 | A | | 7/1996 | Seber et al. | |
| 5,689,885 | A | | 11/1997 | Walston | |
| 5,692,304 | A | | 12/1997 | Campbell | |
| 5,737,841 | A | * | 4/1998 | McHenry et al. | 30/161 |
| 5,755,035 | A | | 5/1998 | Weatherly | |
| 5,802,722 | A | * | 9/1998 | Maxey et al. | 30/161 |
| 5,815,927 | A | * | 10/1998 | Collins | 30/161 |
| 5,822,866 | A | | 10/1998 | Pardue | |
| 5,826,340 | A | | 10/1998 | Hull | |
| 5,887,347 | A | | 3/1999 | Gibbs | |
| 5,964,036 | A | | 10/1999 | Centofante | |
| 6,145,202 | A | * | 11/2000 | Onion | 30/160 |

FOREIGN PATENT DOCUMENTS

| | | |
|---|---|---|
| DE | 1104386 | 4/1961 |
| FR | 1069862 | 7/1954 |
| FR | 1248117 | 10/1960 |

* cited by examiner

*Primary Examiner*—Hwei-Siu Payer
(74) *Attorney, Agent, or Firm*—Kolisch Hartwell Dickinson McCormack & Heuser

(57) ABSTRACT

This invention relates to a mechanism in a folding knife that urges the blade to move to an open and alternatively to a closed position. The knife generally consists of a blade having a tang extending outwardly from the blade; a handle having at least one recessed portion; a bar pivotally connecting the tang and the handle; and a bias element engaging the blade wherein the bias element is housed within the recessed portion of the handle. Generally, in the present invention, the blade must be moved manually a certain distance whereupon the mechanism serves to complete the movement of the blade without the application of further outside force by the user.

45 Claims, 2 Drawing Sheets

FIG. 6
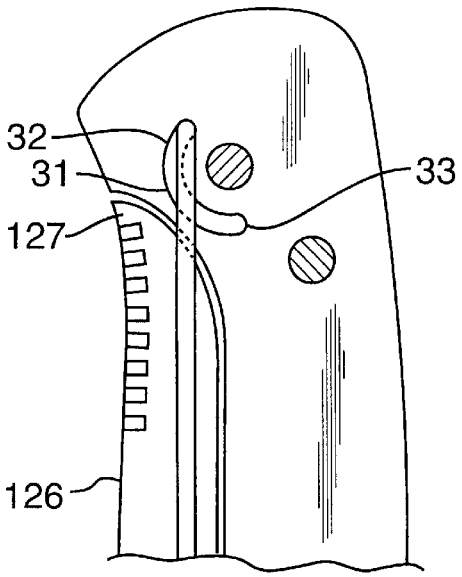
FIG. 7
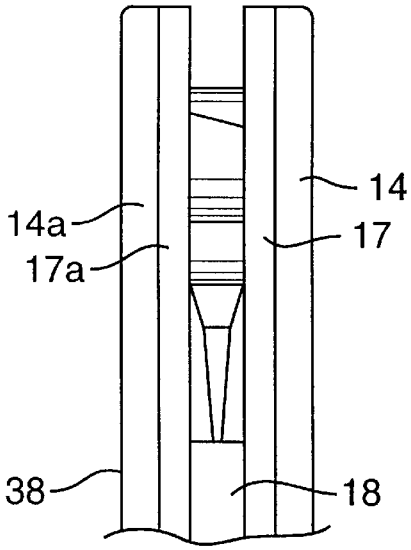
FIG. 8
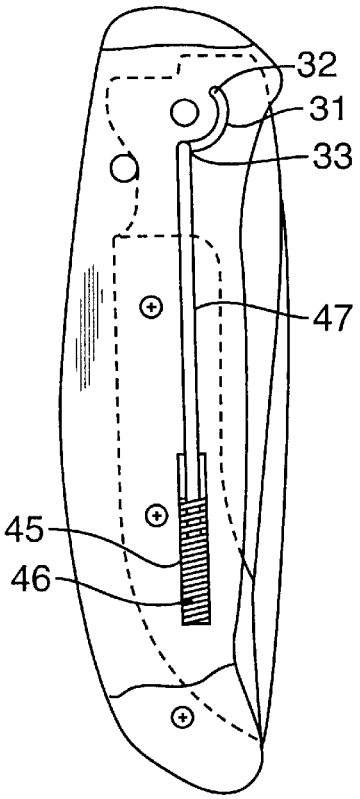
FIG. 9
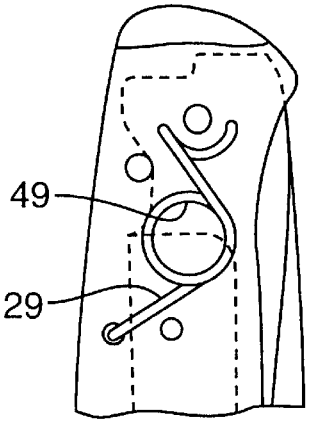
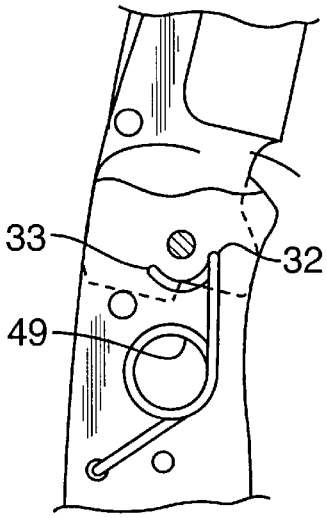
FIG. 10

OPENING AND CLOSING ASSISTING MECHANISM FOR A FOLDING KNIFE

CROSS-REFERENCE TO RELATED APPLICATIONS

This application is a continuation of U.S. patent application Ser. No. 09/096,870, filed Jun. 11, 1998 now U.S. Pat. No. 6,145,202 for AN OPENING AND CLOSING ASSISTING MECHANISM FOR A FOLDING KNIFE, which claims the benefit of priority of U.S. Provisional Patent Application Ser. No. 60/077,390, filed Mar. 10, 1998 for AN OPENING AND CLOSING ASSISTING MECHANISM FOR A FOLDING KNIFE. These applications are incorporated herein by reference.

BACKGROUND OF THE INVENTION

This invention relates to a mechanism in a folding knife that urges the blade to move to an open and alternatively to a closed position. Generally, in the present invention, the blade must be moved manually a certain distance, whereupon the mechanism serves to complete the movement of the blade without the application of further outside force by the user.

In the folding knife and cutlery industry, there typically is provided a folding knife having a housing or handle for supporting the blade in the open position and for receiving the blade in the closed position. It also is known generally to cause the blade of the knife to be locked when in the open position. An example of such locking mechanism is found in Neely, U.S. Pat. No. 5,060,379 and Wiethoff, U.S. Pat. No. 4,404,748. The mechanism of the present invention overcomes the various deficiencies of the folding knives and opening and closing mechanisms presently in the knife and cutlery industry by providing positive opening and closing assistance while enabling such opening and closing to be performed or carried out with only a single hand of the user, to the advantage of the general public, but especially to persons who experience difficulty in using two hands to open a knife, whether such arcuity is caused by physical, mental, or safety reasons.

SUMMARY OF THE INVENTION

The present invention generally provides for a folding knife generally comprising a blade, a handle for receiving and supporting the blade, and a mechanism located within the handle that communicates with the blade and provides positive assistance for opening and closing of the blade. The mechanism generally includes a bias element in communication with an arcuate slot in the tang of the blade. A thumb bob or stud may be attached to the blade for ease of opening and a locking means, such as a liner lock, may be provided within the handle of said knife for locking the blade in the open position.

DESCRIPTION OF THE DRAWINGS

FIG. 6 is an enlarged sectional view of an alternate embodiment of the knife, taken along line 6,6 of FIG. 5;

FIG. 7 is an enlarged sectional view of the knife, taken along lines 7,7 of FIG. 3;

FIG. 8 is a modified side view of the knife in the closed position of an alternate embodiment of the present invention;

FIG. 9 is a fragmentary side view of the knife in a closed position of a second alternate embodiment;

FIG. 10 is a fragmentary side view of an alternate embodiment in the open position.

DESCRIPTION OF THE PREFERRED EMBODIMENT

Figure 1:
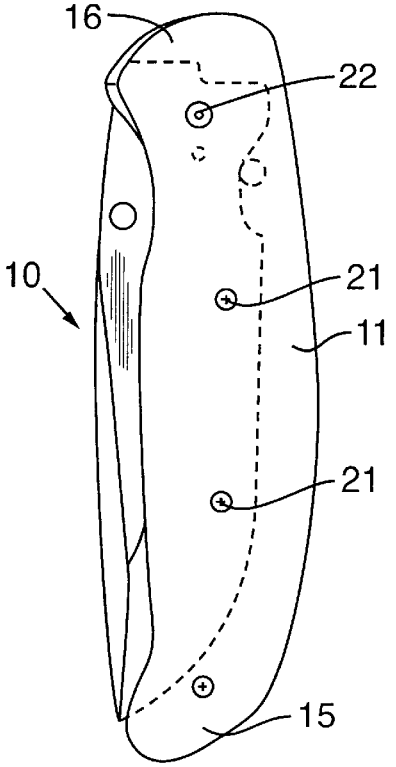
FIG. 1 of the drawings is a side view of the knife embodying the present invention.
Figure 2:
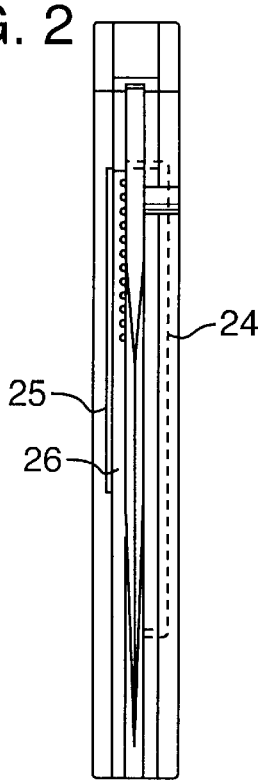
FIG. 2 is a top view of the knife in the closed position.

Referring to FIGS. 1–7, the knife 10 generally is composed of a handle or casing 11, a mechanism 12 held within the handle or casing and a blade 13.

The handle has side parts 14, 14*a*, each with a tapered rear end 15 and a rounded front end 16. Each side has an interior lining 17, 17*a* which communicates with the outer edge of the interior side of parts 14, 14*a*. The interior linings are connected to a central casing member 18 which communicates with the interior linings bottom and rear edges to form a central cavity 19. The interior of the central casing 18 is curved according to the shape of the blade and forms a stop for the blade when the blade is placed in the closed position. Each side part and lining has a plurality of threaded holes 21 that receive screws which secure the sides together and an opening for a pivot bar 22. The interior linings are joined near the front end 16 of the handle by a stop bar 23.

Figure 5:
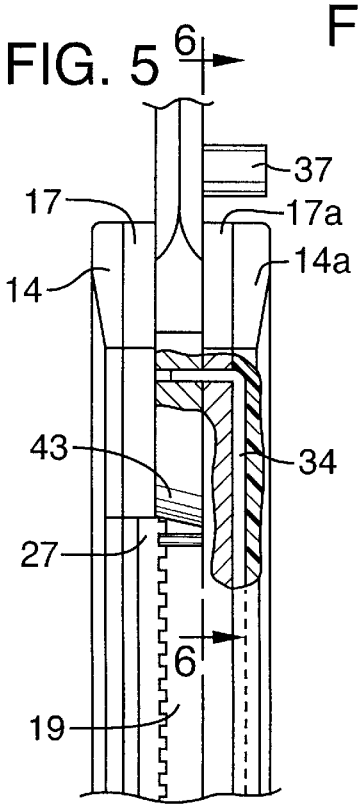
FIG. 5 is an enlarged partial top view of the knife in the open position, taken along the lines 5,5 of FIG. 4.

Side part 14*a* has a recessed portion 24 that does not communicate with the interior lining, and side part 14 has a recess 25. A portion of interior lining 17, indicated in FIG. 2 as lining portion 26, is separate from the lining 17 at the front end of the handle and is displaceable. Portion 26 is biased like a leaf spring so that the lining portion 26 extends into the central opening 19 of the handle when the blade is placed in the open position, as shown in FIG. 5. The forward end 27 of the displaceable lining portion 26 communicates with the tang 28 of the blade when the blade is in the open position so as to prevent folding of the blade into the central cavity 19 because free end 27 is in the path of travel of tang 28, preventing pivoting of blade 13.

A side view of a lining portion 126 is shown in FIG. 6, as part of an alternative embodiment of the present knife, in which the moveable lining portion 126 is formed in interior lining 17*a*, on the same side of the handle as recessed portion 24. For both embodiments, the recess adjacent the moveable lining portion 26 or 126 allows free end 27 or 127 to be pressed manually so that free end 27 or 127 is completely out of the path of travel of tang 28, allowing following of the blade back into the central cavity 19.

Figure 4:
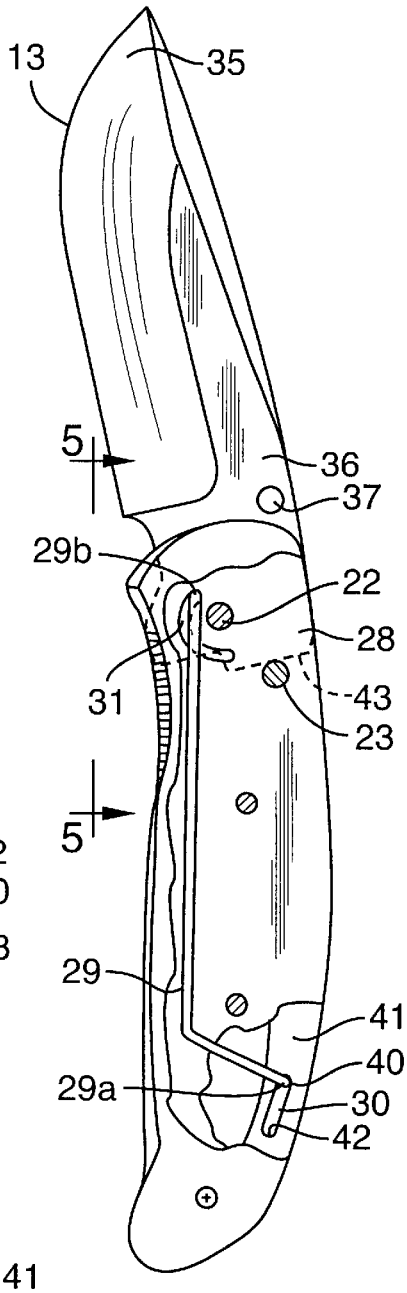
FIG. 4 is a side view of the knife in the open position displaying the preferred assisting mechanism within the handle, with portions broken away better to illustrate the construction or the knife.
Figure 3:
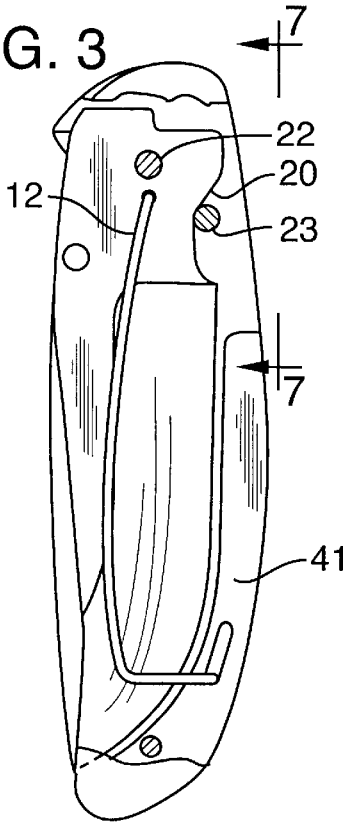
FIG. 3 is a side view of the knife in the closed position displaying the preferred assisting mechanism within the handle with portions broken away better to illustrate the construction of the knife.

The recessed portion 24 houses a mechanism 12 generally composed of a bias element 29 that is operatively connected to handle 11 through a first groove 30 formed in a back strap 41 or like structure as shown in FIGS. 3 and 4. First groove 30 may also be formed in interior lining 17*a*, as shown in FIG. 5. Bias element 29 also is operatively connected to blade 13 through a second groove 31. The bias element is generally the length of the handle and has a bent end 29*a* and a second bent end 29*b*. The first and second ends are turned at approximately 90° from the body 34 of the bias element. The first end 29*a* is received within the first groove 30. The second end 29*b* is located near the front 16 of the handle and is received within an arcuate second groove 31 in the interior lining 17 and a corresponding hole in the tang 28 of the blade 13.

Stop bar 23 extends across the front end of the central cavity 19. The stop bar fits within a recess 20 in the tang of the blade when the blade is in the closed position and communicates with the rear end 43 of the tang when the blade is in the open position.

The blade has a distal end 35 and a proximal end 36, with tang 28 adjacent to the proximal end of the blade. Thumb bob 37 is mounted on a side of the blade near the proximal end and outside the tang area. The tang has an arcuate slot corresponding to groove 31 capable of receiving a bent front end of the biased element 29, and a recessed area generally conforming to the stop bar, and a hole for receiving a pivot bar 22.

In operation, the knife in a closed position is grasped with the rear end 15 of the handle oriented towards the holder's wrist and the bottom 38 of the handle resting in the palm resulting in placement of the thumb bob 37 in close proximity to the holder's thumb. Pressure is applied to the thumb bob 37 upwards in the direction away from the palm, causing the blade to rotate clockwise about the pivot bar 22 and exit the central cavity 19. As the blade is lifted out of the central cavity 19, the bias element 29 is moved past an equilibrium point, after which the bias element 29 exerts an opening force on the blade 13. When the end 29*b* reaches a certain critical angle in the arcuate groove 31, the tension of the bias element 29 causes the end 29*b* to quickly slide towards the end 32 of the arcuate slot, thereby causing the blade to extend to the full open position. Stop bar 23 communicates with the rear end 43 of the tang to prevent overextension of the blade. When the blade is in the fully extended position, the front end 29*b* of the bias element rests at the far end 32 of the arcuate groove and the rear end 29*a* of the bias element is positioned at the front end 40 of the rear groove 30. When the blade clears the moveable lining, the free end 27 of the lining free end 27 extends into the central cavity and becomes lodged against the rear end 43 of the tang, thereby preventing the blade from closing.

To close the knife, pressure is applied to the moveable free end 27 of interior lining 17, dislodging the end of the lining from the tang, placing the moveable lining in linear arrangement with the lining 17. The blade then is rotated counterclockwise about the pivot bar 22 towards the central cavity 19, causing the front bias element end 29*b* to slide toward the rear 33 of the arcuate groove 31. When the front bias element end 29*b* reaches a certain critical angle in the arcuate groove 31, the rear end 29*a* of the bias element travels to the rear end 42 of the groove 30, thereby permitting the front end 29*b* of the bias element to travel to the rear bottom position 33, causing the blade to fold into the central cavity. In the closed position, the bottom edge of the blade rests against the central casing 18 and the stop bar 23 is received within the recessed 20 of the tang, preventing further movement of the blade in the closing direction.

It will be appreciated that the mechanism provides positive pressure that facilitates movement of the blade, requiring only limited outside assistance by the user. The amount of outside assistance required to open and close the blade depends upon the angle of the arcuate groove, the length of end positioning of the first groove and the resilience of the bias element.

The bias element can be a material such as a spring, wire or equivalent thereof as shown in each of FIGS. 2–6 and 8–10. Furthermore, the bias element or spring may include an integral pushrod as shown in FIGS. 3–6, 9 and 10. As seen spring, wire or equivalent thereof and may include an integral pushrod as shown in FIG. 3. As seen in the various depicted embodiments, the spring or bias element may be bent in a variety of ways. For example, as seen in FIGS. 3 and 4, the spring or bias element may include a simple bend formed between the opposed ends of the spring or bias element. The simple bend may be 90° and, more particularly, may be approximately 120°, as seen in FIG. 4. FIGS. 9 and 10 show that the spring or bias element may have a coiled bend instead of a simple bend. The coiled bend may be 360° or greater, as revealed by FIGS. 9 and 10. For example, the coiled bend shown in FIG. 10 is approximately 480°. The preferred element for the spring or bias element is 0.062 music wire.

In alternative embodiments, the bias element can be a combination of a spring and a push rod, a coiled wire, or similar means. Referring to FIG. 8, the bias element consists of push rod 47 and helical spring 46 which is housed within longitudinal slot 45 defined between interior lining 17*a* and a recess in side part 14*a,* similar to the way in which bias element 29 is housed in the embodiments shown in FIGS. 1–6. Referring to FIGS. 9 and 10, bias element 29 consists of a wire wrapped or coiled about a circular member 49. Other embodiments may be possible based upon the principles disclosed herein. Moreover, the shape of the tang may be modified according to known designs.

In all embodiments, the liner log may be changed to be a lockback or other known locking mechanism. Moreover, the blade may have a thumb bob on both sides of the blade, and the dual thumb bobs may serve as a stop for the blade when in the closed position. From the foregoing, it will be seen that this invention is one well adapted to attain all the ends and objects hereinabove set forth together with other advantages which are obvious and which are inherent to this structure. It will be understood that certain features and some combinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A knife comprising:

a blade pivotally mounted to a handle, the blade defining a plane of travel relative to the handle as the blade pivots into and out of the handle;

a spring operatively connected between the handle and the blade to assist in the opening of the blade, wherein the spring operates on the blade through a cavity formed in the handle, the cavity extending parallel to and spaced outwardly from the plane of travel of the blade; and a lining interposed between the cavity and the blade, thereby at least partially enclosing the cavity.

2. The knife according to claim 1, wherein the lining has an arcuate opening through which the spring operates on the blade.

3. The knife according to claim 1, wherein the lining has an elongate opening through which the spring operates on the handle.

4. The knife according to claim 3, wherein the lining has an arcuate opening through which the spring operates on the blade.

5. The knife according to claim 1, wherein the spring extends from the handle to the blade.

6. The knife according to claim 1, wherein the spring is a substantially planar bent wire spring.

7. The knife according to claim 1, further comprising a back strap as part of the handle, the back strap including an elongate hole for receiving an end of the spring.

8. The knife according to claim 1, wherein there is a push rod extending through the cavity and connecting the blade to the spring.

9. The knife according to claim 1, wherein the spring is spaced away from the blade.

10. The knife according to claim 1, wherein the cavity through which the spring operates on the blade is in only one side of the handle.

11. A spring-assisted-opening knife comprising:

a handle;

a blade pivotally connected to the handle;

a cavity defined in the handle at least partially to one side of the blade relative to a path of travel of the blade;

a spring for operating on the blade to assist in the opening of the blade when the blade is pivoted out of the handle beyond an equilibrium point;

a push rod extending through the cavity and operatively connecting the blade to the spring; and a lining for operatively retaining the push rod at least partially within the cavity.

12. The knife according to claim 11, wherein the lining has an arcuate opening through which the spring operates on the blade.

13. The knife according to claim 11, wherein the lining has an elongate opening through which the spring operates on the handle.

14. The knife according to claim 13, wherein the lining has an arcuate opening through which the spring operates on the blade.

15. The knife according to claim 11, wherein the spring extends from the handle to the blade, and is formed integrally with the push rod.

16. The knife according to claim 11, wherein the spring is a substantially planar bent wire spring.

17. The knife according to claim 11, further comprising a back strap as part of the handle, the back strap including an elongate hole for receiving an end of the spring.

18. The knife according to claim 11, wherein the spring is spaced away from the blade.

19. A spring-assisted-opening knife comprising:

a handle;

a blade pivotally connected to the handle;

a spring for operating on the blade to assist in the opening of the blade when the blade is pivoted out of the handle to an equilibrium point; and a push rod having a first end directly contacting the spring, a second end directly contacting the blade, and an intervening body extending from close to the spring to close to the blade completely to one side of the blade relative to a path of travel of the blade.

20. The knife according to claim 19, further comprising a lining between the blade and at least a portion of the push rod, wherein the lining has an arcuate opening through which the spring operates on the blade via the push rod.

21. The knife according to claim 19, further comprising a lining between the blade and at least a portion of the push rod, wherein the lining has an elongate opening through which the spring operates on the handle.

22. The knife according to claim 21, wherein the lining has an arcuate opening through which the spring operates on the blade via the push rod.

23. The knife according to claim 19, wherein the spring extends from the handle to the blade, and is formed integrally with the push rod.

24. The knife according to claim 19, wherein the spring is a substantially planar bent wire spring.

25. The knife according to claim 19, further comprising a back strap as part of the handle, the back strap including an elongate hole for receiving at least an end of the spring.

26. The knife according to claim 19, wherein the spring is spaced away from the blade.

27. An improved assisted-opening knife having a handle, a blade that pivots into the handle thereby defining a plane of travel relative to the handle as the blade pivots into and out of the handle, a lining in at least one side of the handle, between the blade and the handle, and a spring exerting an operating force relative to the handle and the blade, the improvement comprising a cavity that is formed at least partially in the handle spaced outwardly from the plane of travel of the blade and between the lining and the handle, the cavity allowing the spring to operate at least partially therethrough on the blade.

28. The knife according to claim 27, wherein the lining has an arcuate opening through which the spring operates on the blade.

29. The knife according to claim 27, wherein the lining has an elongate opening through which the spring operates on the handle.

30. The knife according to claim 29, wherein the lining has an arcuate opening through which the spring operates on the blade.

31. The knife according to claim 27, wherein the spring extends from the handle to the blade.

32. The knife according to claim 27, wherein the spring is a substantially planar bent wire spring.

33. The knife according to claim 27, further comprising a back strap as part of the handle, the back strap including an elongate hole for receiving an end of the spring.

34. The knife according to claim 27, wherein there is a push rod extending through the cavity and connecting the blade to the spring.

35. The knife according to claim 27, wherein the spring is spaced away from the blade.

36. The knife according to claim 27, wherein the cavity through which the spring operates on the blade is in only one side of the handle.

37. A knife comprising:

a blade pivotally mounted to a handle, the blade defining a plane of travel relative to the handle as the blade pivots into and out of the handle;

a bias element connected between the handle and the blade to assist in the opening of the blade, wherein the bias element operates on the blade through a cavity formed in the handle, the cavity extending parallel to and spaced outwardly from the plane of travel of the blade; and a lining interposed between the cavity and the blade, thereby at least partially enclosing the cavity.

38. The knife according to claim 37, wherein the lining has an arcuate opening through which the bias element operates on the blade.

39. The knife according to claim 37, wherein the lining has an elongate opening through which the bias element operates on the handle.

40. The knife according to claim 39, wherein the lining has an arcuate opening through which the bias element operates on the blade.

41. The knife according to claim 37, wherein the bias element includes a spring that extends from the handle to the blade.

42. The knife according to claim 41, wherein the spring is a substantially planar bent wire spring.

43. The knife according to claim 37, further comprising a back strap as part of the handle, the back strap including an elongate hole for receiving an end of the bias element.

44. The knife according to claim 37, wherein the bias element includes a spring and a push rod extending through the cavity and connecting the blade to the spring.

45. The knife according to claim 37, wherein the cavity through which the bias element operates on the blade is in only one side of the handle.

* * * * *